US009556583B2

(12) United States Patent
Guo et al.

(10) Patent No.: US 9,556,583 B2
(45) Date of Patent: Jan. 31, 2017

(54) AUTOMATIC GRADING SYSTEM FOR CONSTRUCTION MACHINE AND METHOD FOR CONTROLLING THE SAME

(71) Applicant: VOLVO CONSTRUCTION EQUIPMENT AB, Eskilstuna (SE)

(72) Inventors: Peng Guo, Changwon-si (KR); Ying Meng, Changwon-si (KR); Lu Tian, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 0 days.

(21) Appl. No.: 14/430,852

(22) PCT Filed: Sep. 25, 2012

(86) PCT No.: PCT/KR2012/007683

§ 371 (c)(1),
(2) Date: Mar. 24, 2015

(87) PCT Pub. No.: WO2014/051170

PCT Pub. Date: Apr. 3, 2014

(65) Prior Publication Data

US 2015/0240445 A1 Aug. 27, 2015

(51) Int. Cl.

| | |
|---|---|
| ***G06F 19/00*** | (2011.01) |
| ***E02F 3/43*** | (2006.01) |
| ***E02F 9/20*** | (2006.01) |

(52) U.S. Cl.

CPC ..... *E02F 3/434* (2013.01); *E02F 3/435* (2013.01); *E02F 9/20* (2013.01); *E02F 9/2025* (2013.01)

(58) Field of Classification Search

CPC ..... E02F 3/434; E02F 3/435; E02F 9/20; E02F 9/2025; E02F 3/437; E02F 9/2285; E02F 9/2033; E02F 9/2292; E02F 9/2296; E02F 9/265; E02F 9/2203; E02F 9/264; E02F 3/303; E02F 3/3411; E02F 3/432; E02F 3/439; E02F 9/2004; E02F 9/2029; E02F 9/2228

(Continued)

(56) References Cited

U.S. PATENT DOCUMENTS 4,332,517 A * 6/1982 Igarashi ..... E02F 3/437 172/4.5
4,741,646 A * 5/1988 Hatch ..... E02F 5/104 37/348

(Continued)

FOREIGN PATENT DOCUMENTS

EP 0801174 A1 10/1997
JP 07-180173 A 7/1995

(Continued)

OTHER PUBLICATIONS

International Search Report and Written Opinion (both in English) for PCT/KR2012/007683, mailed Apr. 25, 2013; ISA/KR.

*Primary Examiner* — Khoi Tran
*Assistant Examiner* — Jorge Peche
(74) *Attorney, Agent, or Firm* — Harness, Dickey & Pierce, P.L.C.

(57) ABSTRACT

The present invention relates to an automatic grading system for a construction machine, including: a work apparatus having a boom connected pivotally to one side of a vehicle body, an arm connected pivotally to a front end portion of the boom, and a bucket connected pivotally to a front end portion of the arm; a boom angle detection sensor mounted on one side of the boom; an arm angle detection sensor mounted on one side of the arm; a switch panel on which a standard grading mode switch, a grading history storage switch, and a history grading mode switch selected for a grading work are disposed; an electronic control unit (Continued)

adapted to receive grade input signals applied from the angle detection sensors at the time when the grading mode switches and a joystick for controlling the work apparatus are manipulated and to calculate the grade input signals in accordance with a predetermined control algorithm.

7 Claims, 4 Drawing Sheets

(58) Field of Classification Search
USPC ..... 701/50, 52, 60
See application file for complete search history.

(56) References Cited

U.S. PATENT DOCUMENTS 4,889,466 A * 12/1989 Jindai ..... E02F 3/301 172/4.5
5,116,186 A * 5/1992 Hanamoto ..... E02F 3/438 37/348
5,178,510 A * 1/1993 Hanamoto ..... E02F 3/438 37/348
5,598,648 A * 2/1997 Moriya ..... E02F 3/437 37/348
5,704,429 A * 1/1998 Lee ..... E02F 9/2025 172/4.5
5,735,066 A * 4/1998 Tochizawa ..... E02F 3/435 37/348
5,782,018 A * 7/1998 Tozawa ..... E02F 3/437 37/348
5,794,369 A * 8/1998 Lee ..... E02F 3/437 37/348
5,835,874 A * 11/1998 Hirata ..... E02F 3/435 414/4
5,903,988 A * 5/1999 Tochizawa ..... E02F 3/437 37/348
5,968,104 A * 10/1999 Egawa ..... E02F 3/435 37/414
6,098,322 A * 8/2000 Tozawa ..... E02F 3/437 37/414
6,169,948 B1 * 1/2001 Fujishima ..... E02F 3/435 172/4.5
6,209,232 B1 * 4/2001 Ono ..... E02F 3/435 37/348
6,246,939 B1 * 6/2001 Nozawa ..... E02F 3/3411 172/810
6,317,669 B1 * 11/2001 Kurenuma ..... E02F 3/434 172/2
7,925,439 B2 * 4/2011 McCain ..... E02F 3/435 701/468
9,212,468 B2 * 12/2015 Sugiyama ..... E02F 9/2091
9,249,556 B2 * 2/2016 Magaki ..... E02F 9/2214
9,315,969 B2 * 4/2016 Uchiyama ..... E02F 9/2246
2003/0147727 A1 * 8/2003 Fujishima ..... E02F 3/435 414/200
2005/0138850 A1 * 6/2005 Brickner ..... E02F 9/2025 37/348
2010/0106381 A1 * 4/2010 Pline ..... E02F 3/439 701/50
2014/0303855 A1 * 10/2014 Umeda ..... E02F 9/123 701/50
2015/0147147 A1 * 5/2015 Uchiyama ..... E02F 3/32 414/687
2015/0275478 A1 * 10/2015 Yanagisawa ..... E02F 3/32 414/687
2015/0275483 A1 * 10/2015 Tsukamoto ..... E02F 3/435 701/50
2015/0284930 A1 * 10/2015 Tsukamoto ..... E02F 3/435 701/50
2015/0284931 A1 * 10/2015 Tsukamoto ..... E02F 3/435 701/50

FOREIGN PATENT DOCUMENTS

KR 10-1994-0002438 A 2/1994
WO WO-92-04506 A1 3/1992

* cited by examiner

AUTOMATIC GRADING SYSTEM FOR CONSTRUCTION MACHINE AND METHOD FOR CONTROLLING THE SAME

CROSS-REFERENCE TO RELATED APPLICATION

This application is a 371 U.S. National Stage of International Application No. PCT/KR2012/007683, filed on Sep. 25, 2012. The entire disclosure of the above application is hereby incorporated by reference.

TECHNICAL FIELD

The present invention relates to an automatic grading system for a construction machine and a method for controlling the same, and more particularly, to an automatic grading system for a construction machine and a method for controlling the same that is capable of performing a grading work, while constantly maintaining the angular movement of a bucket of the construction machine and variably controlling the angular movements of boom and arm of the construction machine.

BACKGROUND ART

Construction machines such as excavators and hydraulic shovels have boom, arm and bucket as their work apparatus, and in this case, they have respective joint structures through which the boom having a given dimension is connected pivotally to a vehicle body, the arm is connected pivotally to the boom at a given angle, and the bucket is connected pivotally to the arm at a given angle.

Each construction machine includes work apparatus manipulation means having a plurality of control levers and foot pedals adapted to activate the work apparatus inclusive of the boom, arm and bucket, and thus, the grading function is performed by the complicated operation of the boom, arm and bucket as the work apparatus.

For example, continuous multiple linkage movements or pivot movements of the boom, arm and bucket of the construction machine are carried out on the ground within a given radius range from the vehicle body, so that if a manual type grading work is performed, the movements of the boom, arm and bucket carried out by their respective hydraulic cylinders from the initial position of the grading area to the final position thereof should be continuously controlled by the operator of the construction machine.

Accordingly, the manual type grading work needs the operator's skilled experiences and high concentration for the complicated operation of the work apparatus, and therefore, the working efficiency may be often decreased due to his fatigue or malfunctioning manipulations.

So as to remove the above-mentioned problems, there have been proposed automatic grading systems for automatically controlling the movements of the work apparatus. One of the conventional automatic grading systems is disclosed in Korean Patent Laid-Open No. 1994-0002438 wherein an automatic control device for a construction machine is proposed to control optimal moving tracks of a work apparatus.

The conventional automatic grading system produces optimal working paths, while the moving angles of the boom, arm and bucket set initially by an operator are being continuously varied. For example, if initial excavating position and angle are inputted by the operator, the optimal working paths are calculated by a control unit to obtain an arm moving angle $\alpha(t)$, a boom moving angle $\beta(t)$ and a bucket moving angle $\gamma(t)$ as the angular movements required for the moving arm, boom and bucket. At this time, the obtained moving angles of the arm, boom and bucket produce the optimal working paths through a given algorithm inclusive of PID operation.

According to the conventional automatic grading system, the grading work is performed, while the moving angles of the boom, arm and bucket are being continuously varied to produce the optimal working paths.

However, the conventional automatic grading system becomes complicated in continuously determining and controlling the angular movements or paths of the boom, arm and bucket, and unfortunately, the conventional system substantially increases the quantities of hydraulic pressure and fuel consumed for activating the boom, arm and bucket.

DISCLOSURE OF INVENTION

Technical Problem

Accordingly, the present invention has been made in view of the above-mentioned problems occurring in the prior art, and it is an object of the present invention to provide an automatic grading system for a construction machine and a method for controlling the same that is capable of allowing an operator to easily select an appropriate grading mode in accordance with the states of the ground on a grading area and constantly maintaining the angular movement of a bucket of the construction machine at a starting angle, during the grading work after the grading mode has been selected, while variably controlling the angular movements of boom and arm of the construction machine.

It is another object of the present invention to provide an automatic grading system for a construction machine and a method for controlling the same that is capable of storing the movements of a boom, an arm and a bucket in a grading area on the ground and the hydraulic pressures required for the movements as a grading history data and automatically or repeatedly performing the movements of the respective boom, arm and bucket in a whole grading area, while being dependent upon the stored grading history data.

It is yet another object of the present invention to provide an automatic grading system for a construction machine and a method for controlling the same that is capable of minimizing the angular movement of a bucket of the construction machine during a grading work on the ground, thereby substantially reducing the quantities of hydraulic pressure and fuel consumed for controlling the movements of the work apparatus.

Solution to Problem

To accomplish the above objects, according to a first aspect of the present invention, there is provided an automatic grading system for a construction machine, including: a work apparatus having a boom connected pivotally to one side of a vehicle body, an arm connected pivotally to a front end portion of the boom, and a bucket connected pivotally to a front end portion of the arm; a boom angle detection sensor mounted on one side of the boom so as to sense the angular movement of the boom with respect to the vehicle body; an arm angle detection sensor mounted on one side of the arm so as to sense the angular movement of the arm with respect to the boom; a switch panel on which a standard grading mode switch, a grading history storage switch, and a history grading mode switch selected for a grading work are disposed; an electronic control unit adapted to receive grade input signals applied from the angle detection sensors at the time when the grading mode switches and a joystick for controlling the work apparatus are manipulated and to calculate the grade input signals in accordance with a predetermined control algorithm to output grade control signals for controlling the angular movements of the boom, arm and bucket, so that the angular movement of the bucket is fixed to a given starting angle from an initial grading position to a final grading position and the angular movements of the boom and arm are determined as variable angles to maintain the given starting angle; and work apparatus control valves adapted to control the hydraulic pressures for driving a boom cylinder, an arm cylinder and a bucket cylinder in response to the grade control signals.

According to the present invention, preferably, if the history grading mode switch is pressed, the grade control signals determined by the angular movements of the boom, arm and bucket within the initial grading area from the initial grading position to the final grading position are recorded as given grading history data in the electronic control unit, and through the grading history data, the work apparatus is repeatedly operated in the contiguous grading area.

According to the present invention, preferably, the grade control signals include flow rate control signals needed for driving the boom cylinder and the arm cylinder to perform the angular movements of the boom and arm.

According to the present invention, preferably, the joystick for controlling the work apparatus includes a hydraulic joystick.

According to the present invention, preferably, a proportional pressure control valve block for controlling a flow rate of the control valve includes proportional pressure control valves and solenoid valves controlled by the electronic control unit.

According to the present invention, preferably, the automatic grading system further includes a swing angle detection sensor mounted on one side of the vehicle body.

To accomplish the above objects, according to a second aspect of the present invention, there is provided a method for controlling an automatic grading system for a construction machine, the automatic grading system comprising: a switch panel having a plurality of mode switches installed in one side of a vehicle body, a plurality of angle detection sensors for sensing an angular movement of a work apparatus including boom, arm and bucket, an electronic control unit for calculating and outputting grade control signals in accordance with a predetermined control algorithm to control the angular movements of the boom, arm and bucket, and work apparatus control valves adapted to control the hydraulic pressures for activating a boom cylinder, an arm cylinder and a bucket cylinder in response to the grade control signals, the method including the steps of: performing a standard grading mode in an initial grading area G1 if a standard grading mode switch is turned on, the boom, arm and bucket are moved to an initial grading position Gi and set to respective initial angles $\gamma$, $\beta$, and $\alpha$ (at step 100); if the boom, arm and bucket are moved from the initial grading position Gi to a final grading position Ge, calculating the grade control signals inclusive of the angular movements of the boom, arm and bucket and the flow rates required for driving the cylinders in response to input values of the boom angle detection sensor, the arm angle detection sensor and the bucket angle detection sensor in accordance with the predetermined control algorithm in the electronic control unit and determining the angular movements of the boom and arm as given boom variable angle $\gamma L$ and arm variable angle $\beta L$ so as to maintain the initial angle $\alpha$ of the bucket (at step 200); recording the calculated and determined grade control signals in the electronic control unit if a grading history storage switch is manipulated (at step S300); and moving and arranging the boom, arm and bucket to the initial grading position Gi if the history grading mode switch is turned on and repeatedly performing the angular movements of the boom, arm and bucket in accordance with the recorded grade control signals in the contiguous grading area G2 from the initial grading area G1.

Advantageous Effects of Invention

According to the present invention, there is provided the automatic grading system for a construction machine that is capable of allowing the operator to easily select the standard grading mode and the history grading mode in accordance with the states of the ground to be graded and constantly maintaining the angular movement of the bucket at a starting angle, while variably controlling the angular movements of the boom and arm, in accordance with the selected mode.

Additionally, the automatic grading system according to the present invention is capable of storing the movements of the boom, arm and bucket performed in the initial grading area on the ground and the hydraulic pressures required for the movements as a grading history data in the electronic control unit, thereby automatically performing the movements of the work apparatus in the contagious grading area, while being dependent upon the stored grading history data.

BRIEF DESCRIPTION OF DRAWINGS

FIGS. 3A and 3B are schematic views showing the angular movements of the bucket, arm and boom of the construction machine according to the present invention, wherein FIG. 3A shows the states of the angular movements of the bucket, arm and boom of the construction machine on a grading ground, and FIG. 3B shows the states of the boom, arm and bucket moved between a initial grading position and a final grading position.

BEST MODE FOR CARRYING OUT THE INVENTION

Figure 1:
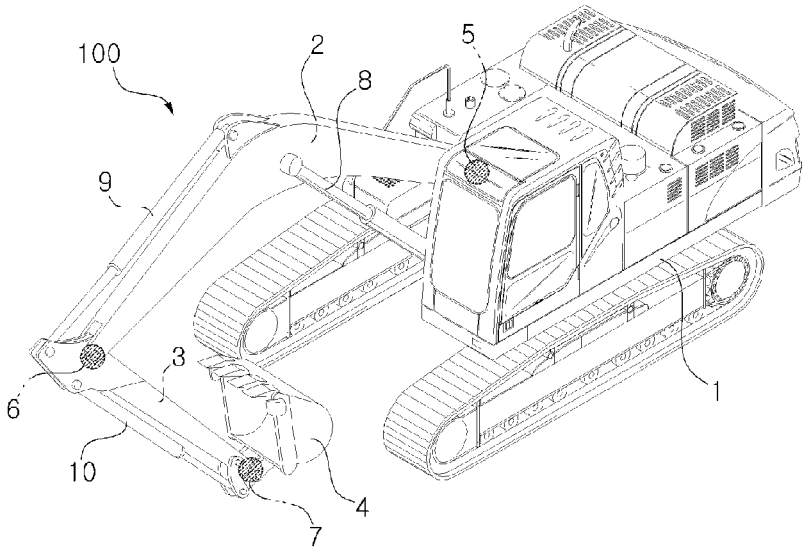
FIG. 1 is a schematic view showing an excavator used as a construction machine according to the present invention.

Hereinafter, an explanation on an automatic grading system for a construction machine and a method for controlling the same according to the present invention will be given with reference to the attached drawings.

Referring to FIGS. 1 to 4, an automatic grading system for a construction machine includes a work apparatus having a boom 2 connected pivotally to one side of a vehicle body 1, an arm 3 connected pivotally to a front end portion of the boom 2, and a bucket 4 connected pivotally to a front end portion of the arm 3.

Typically, the bucket 4 is connected fixedly at the lower portion thereof to the arm 3 by means of a bucket fixing pin 7, thereby being pivotally moved around the bucket fixing pin 7. Further, the arm 3 is connected fixedly at the upper portion thereof by means of an arm fixing pin 6 to the boom 2, thereby being pivotally moved around the arm fixing pin 6, and the boom 2 is connected fixedly at the lower portion thereof by means of a boom fixing pin 5 to the vehicle, thereby being pivotally moved around the boom fixing pin 5.

Figure 3A:
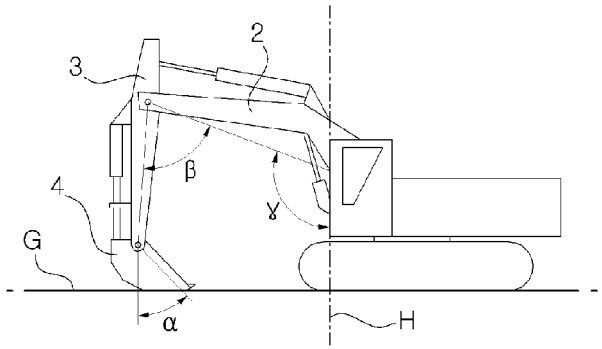

As shown in FIG. 3A, the angular movement of the bucket 4 includes a pivot angle $\alpha$ obtained initially by the fixing angle between the horizontal line of the grading ground G and a bucket tooth around the bucket fixing pin 7. Also, the angular movement of the arm 3 includes a pivot angle $\beta$ obtained by the variation of the angle between the arm 3 and the boom 2 around the arm fixing pin 6, and the angular movement of the boom 2 includes a pivot angle $\gamma$ obtained by the variation of the angle between the boom 2 and the vertical line H of the grading ground G around the boom fixing pin 5.

According to the present invention, the angular movements of the arm 3 and boom 2 can be varied in a grading area during an automatic grading work.

For example, the grading work of the excavator 100 is performed by leveling the ground through the bucket 4 or the bucket teeth under the complicated operation of the boom 2 and arm 3.

Figure 3B:
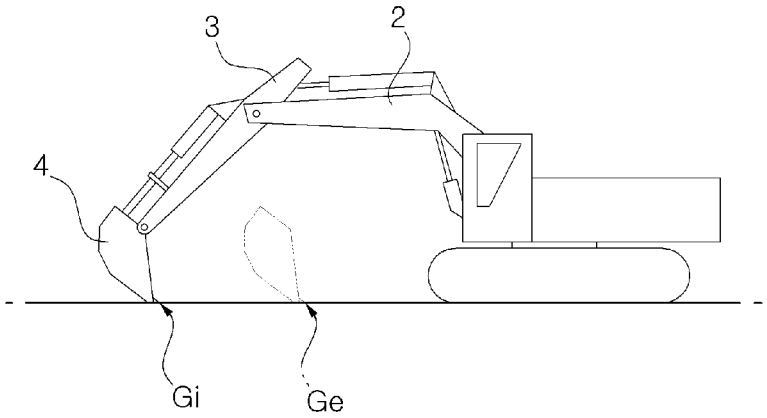

Referring to FIGS. 3A and 3B, under the conditions where the boom 2, arm 3 and bucket 4 have a given dimensions, the adjustment of the angular movements of the boom 2 and arm 3 is obtained by the following relation:

$$Y(\text{bucket tooth})=f(LC,\gamma,LB,\beta,LA,\alpha)=0$$

In the above relation, as noted above, the $\alpha$ indicates the pivot angle of the bucket 4 for the angular movement, the $\beta$ the pivot angle of the arm 3 for the angular movement, and the $\gamma$ the pivot angle of the boom 2 for the angular movement. Further, the LA indicates the distance between the bucket fixing pin 5 and the bucket tooth as the bucket angular movement, the LB the distance between the bucket fixing pin 7 and the arm fixing pin 6 as the arm angular movement, and the LC the distance between the arm fixing pin 6 and the boom fixing pin 5 as the boom angular movement.

According to the present invention, even if the length of the boom, the arm and the bucket of the construction machines is different structurally from each other in accordance with the variable specifications of the construction machines, the pivot angles $\beta$ and $\gamma$ of the arm 3 and boom 2 for their angular movements are inputted to an electronic control unit 14, and they are continuously calculated and determined for performing the automatic grading function in accordance with the predetermined control algorithm in the electronic control unit 14.

So as to sense the angular movement of the work apparatus, in more detail, the automatic grading system for a construction machine according to the present invention includes: a boom angle detection sensor s1 mounted on one side of the boom 2 so as to sense the angular movement of the boom 2 with respect to the vehicle body 1; and an arm angle detection sensor s2 mounted on one side of the arm 3 so as to sense the angular movement of the arm 3 with respect to the boom 2.

Preferably, the angle detection sensors s1 and s2 are mounted adjacent to the fixing pin 5 and 6, respectively.

If the bucket 4 is connected to the lower portion of the arm 3 by means of a link having a quick coupler, further, the automatic grading system for a construction machine according to the present invention includes a bucket angle detection sensor s3 mounted on one side of the link.

Furthermore, the automatic grading system for a construction machine according to the present invention includes a swing angle detection sensor s4 adapted to sense the swing angle $\theta$ of the vehicle body 1 when the vehicle body 1 is turned, and in this case, the swing angle detection sensor s4 is desirably mounted on one side of a turning joint apparatus of the vehicle body 1.

On the other hand, the automatic grading system for a construction machine according to the present invention can perform the grading function through the selection of the grading mode by an operator.

So as to perform the grading function, there is provided a switch panel 20 on which a standard grading mode switch 17, a grading history storage switch 18, and a history grading mode switch 19 are disposed.

The standard grading mode switch 17 or the history grading mode switch 19 is manipulated by the operator, and thus, the grading work can be performed.

According to the present invention, that is, a standard grading mode and a history grading mode can be selectively used through the operator. Especially, the history grading mode is easily adopted in the initial grading area G1 and the contiguous grading area G2 by using the grading history data on the grading work of the work apparatus, and the detailed explanation on the history grading mode will be discussed later.

The electronic control unit 14 adopted in the present invention receives grade input signals applied through the respective angle detection sensors s1, s2, s3 or s4 at the time when the standard grading mode switch 17, the history grading mode switch 19 and the joystick 15 for controlling the work apparatus are manipulated, and calculates the grade input signals in accordance with the predetermined control algorithm to output grade control signals for controlling the angular movements of the boom 2, arm 3 and bucket 4.

The grade control signals include electrical signal or pilot pressure control signals for proportional hydraulic control.

Through the electronic control unit, further, the angular movement of the bucket 4 is fixed to a given starting angle $\alpha$ from an initial grading position Gi to a final grading position Ge, and the angular movements of the boom 2 and arm 3 are determined as variable angles to maintain the given starting angle.

According to the present invention, the work apparatus control valves 16 control the hydraulic pressures for driving a boom cylinder 8, an arm cylinder 9 and a bucket cylinder 10 in response to the grade control signals.

During the grading work, also, the flow rates needed for the boom cylinder 8 and arm cylinder 9 to perform the angular movements of the boom 2 and arm 3 are controlled by means of the work apparatus control valves 16, so that the pivot angle $\gamma$ of the boom and the pivot angle $\beta$ of the arm can be varied.

For example, the electronic control unit 14 can output the grade control signals by which the pivot angle $\beta$ of the arm 3 and the pivot angle $\gamma$ of the boom 3 set at the initial grading position Gi are varied during the complicated operation of the arm 3 and boom 2 for grading the ground.

If the grading mode is selected by the operator (for example, if the standard grading mode switch is turned on), so as to maintain the initial pivot angle α of the bucket 4, the grade control signals of a variable angle βL of the arm 3 and a variable angle γL of the boom 2 are outputted from the electronic control unit 14. Accordingly, the pivot angle of the boom 2 and the pivot angle of the arm 3 are continuously varied, while the pivot angle of the bucket 4 is being maintained constantly to the initial pivot angle α.

MODE FOR THE INVENTION

Figure 7:
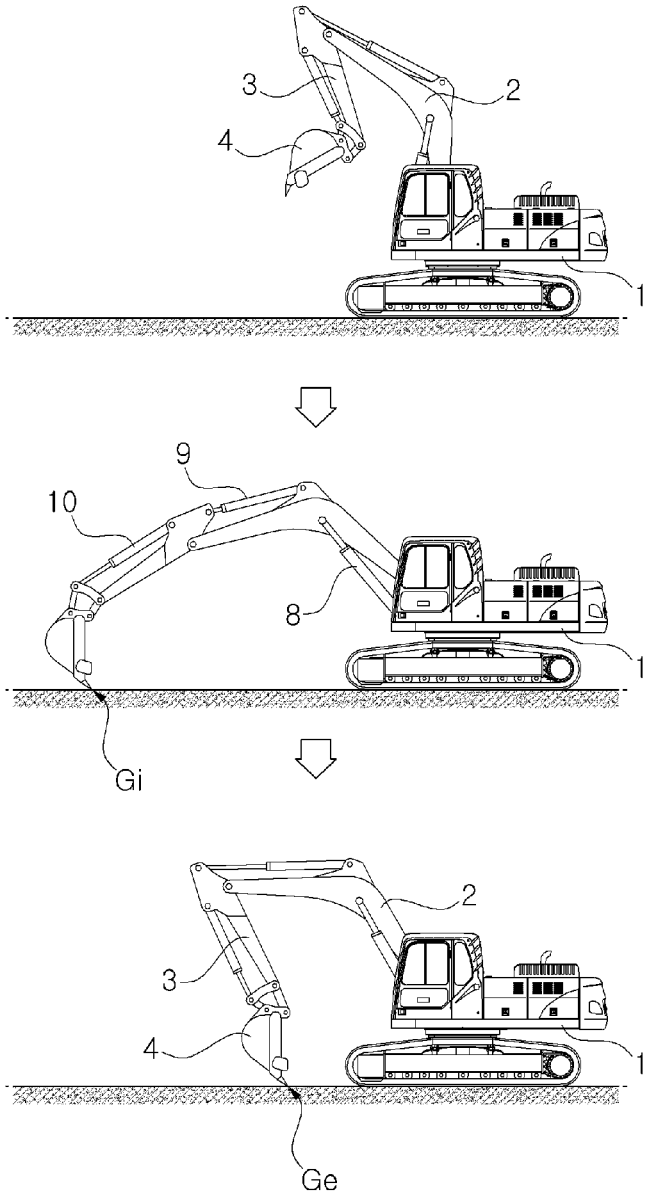
FIG. 7 is a schematic view showing an automatic grading operation of the excavator according to the present invention.

Referring to FIG. 3 and FIG. 7, so as to perform the grading function, the complicated operation of the boom and arm is conducted to maintain the pivot angle α of the bucket 4 or bucket tooth contacted with the ground from the initial grading position Gi to the final grading position Ge. At this time, the arm cylinder 10 is gradually expended or contracted, and the variable angle βL of the arm 3 is controlled to be smaller than the initial pivot angle β. On the other hand, the boom cylinder 2 is gradually expanded or contracted, and the variable angle γL of the boom 2 is controlled to be a little larger than the initial pivot angle γ.

During the grading work on the ground, accordingly, the activation of the work apparatus inclusive of the arm 3 and boom 2 needed for the grading function is automatically controlled, while the angular movement of the bucket 4 is being minimized, thereby substantially reducing the quantities of fuel and hydraulic pressure consumed for the grading work.

Figure 2:
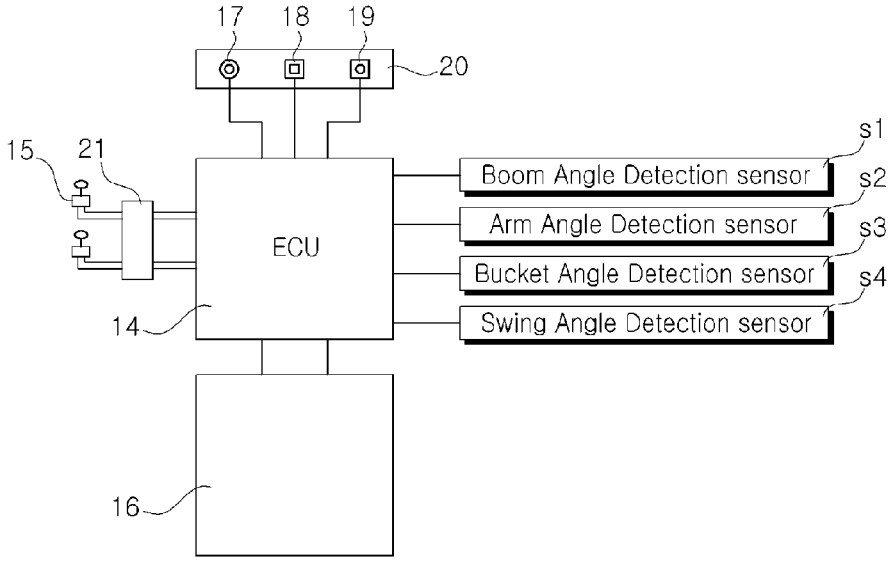
FIG. 2 is a block diagram showing an automatic grading system for a construction machine according to the present invention.
Figure 4:
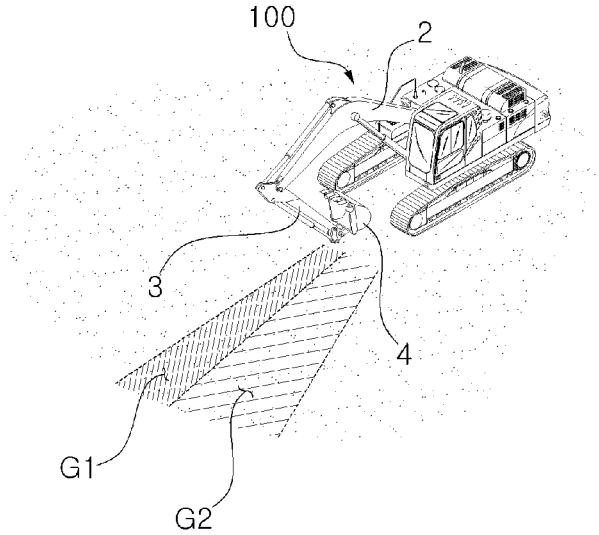
FIG. 4 is a schematic view showing the state where automatic grading mode is performed in the contiguous grading area according to the present invention.

On the other hand, referring to the FIG. 2 to FIG. 4, if the history grading mode switch 19 is manipulated, the grade control signals is generated and determined by the angular movements of the boom 2, arm 3 and bucket 4 within the initial grading area G1 from the initial grading position Gi to the final grading position Ge. The grade control signals by the complicated operation of the work apparatus in the initial grading area G1 are recorded as given grading history data in the electronic control unit 14.

For example, as shown in FIG. 4, the grade control signals recorded as the grading history data in the initial grading area G1 can be used in the contiguous grading area G2 and the angular movements of the work apparatus in the contiguous grading area G2 are controlled by the electronic control unit 14.

If the standard grading mode switch or the history grading mode switch is manipulated by the operator to perform the grading work, the grade input signal applied from the joystick for controlling the work apparatus is inputted to the electronic control unit.

Meanwhile, the joystick 15 for controlling the work apparatus is desirably formed of a hydraulic joystick having a proportional pressure control valve or a proportional pressure control valve block 21 controlled by the electronic control unit 14. At this time, the proportional pressure control valve block 21 includes solenoid valves 22.

Figure 5:
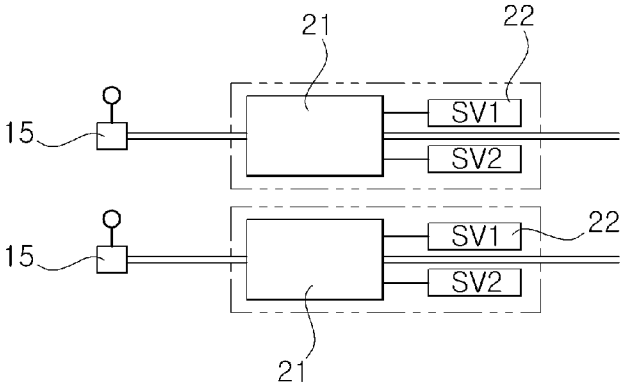
FIG. 5 is a schematic circuit diagram showing a hydraulic joystick function according to the present invention.
Figure 6:
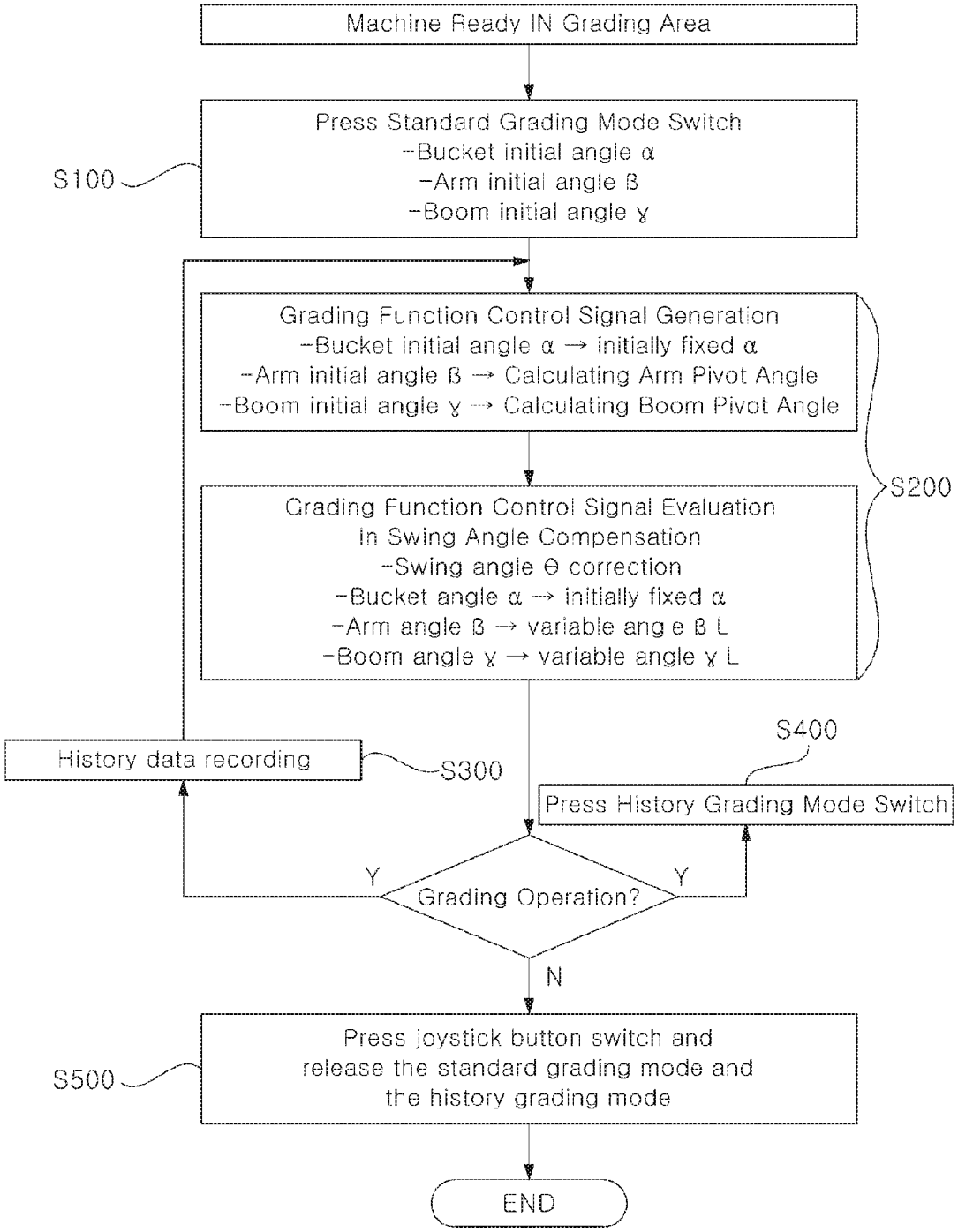
FIG. 6 is a flow chart showing a method for controlling an automatic grading system for a construction machine according to the present invention.

For example, as shown in FIG. 5, the proportional pressure control valves 21 are controlled by the electronic control unit 14 to perform the hydraulic joystick function and to control boom spool and arm spool in the work apparatus control hydraulic valve 16 when the complicated operation of the boom 2 and arm 3 is carried out.

The solenoid valves 22 are also controlled by the electronic control unit, thereby allowing the flows controlled by the respective proportional pressure valves 21 to be open and closed.

On the other hand, there is provided a method for controlling an automatic grading system for a construction machine, the automatic grading system comprising a switch panel 20 having a plurality of mode switches 17, 18 and 19 installed in one side of a vehicle body 1, a plurality of angle detection sensors s1, s2, and s3 for sensing an angular movement of a work apparatus including boom 2, arm 3 and bucket 4, an electronic control unit 14 for calculating and outputting grade control signals in accordance with a predetermined control algorithm to control the angular movements of the boom 2, arm 3 and bucket 4, and work apparatus control valves 16 adapted to control the hydraulic pressures for activating a boom cylinder 8, an arm cylinder 9 and a bucket cylinder 10 in response to the grade control signals, the method including the steps of: performing a standard grading mode in an initial grading area G1 if a standard grading mode switch 17 is turned on, the boom 2, arm 3 and bucket 4 are moved to an initial grading position Gi and set to respective initial angles γ, β, and α (at step 100); if the boom, arm and bucket are moved from the initial grading position to a final grading position, calculating the grade control signals inclusive of the angular movements of the boom 2, arm 3 and bucket 4 and the flow rates required for driving the cylinders 8, 9 and 10 in response to input values of the boom angle detection sensor s1, the arm angle detection sensor s2 and the bucket angle detection sensor s3 in accordance with the predetermined control algorithm in the electronic control unit 14 and determining the angular movements of the boom 2 and arm 3 as given boom variable angle γL and arm variable angle βL so as to maintain the initial angle α of the bucket 4 (at step 200); recording the calculated and determined grade control signals in the electronic control unit 14 if a grading history storage switch 18 is manipulated (at step S300); and moving and arranging the boom 2, arm 3 and bucket 4 to the initial grading position Gi if the history grading mode switch 18 is turned on and repeatedly performing the angular movements of the boom 2, arm 3 and bucket 4 in accordance with the recorded grade control signals in the contiguous grading area G2 from the initial grading area G1.

The method for controlling the automatic grading system for a construction machine further includes the step of cutting off the grade input signals or the grade control signals to release the standard grading mode and the history grading mode if the button of the joystick 15 is manipulated again after the step S200 or the step S400.

The grade input signals include the swing angle θ of the vehicle body 1 applied from the swing angle detection sensor s4, and the grade control signals during the operation of the grading mode include the swing movement of the vehicle body 1 calculated and corrected in accordance with the predetermined control algorithm.

As mentioned above, so as to perform the grading work, the standard grading mode switch 17 or the history grading mode switch 19 can be selectively manipulated through the operator.

As shown in FIG. 2 to FIG. 4, for example, the standard grading mode switch on a switch panel 20 is manipulated by the operator in the initial grading area G1. At this time, the work apparatus including the bucket 2, arm 3 and boom 4 is moved to the initial grading position Gi.

So as to perform the grading function, after that, the complicated operation of the boom 2 and arm 3 is carried to maintain the pivot angle α of the bucket 4 or bucket tooth contacted with the ground from the initial grading position Gi to the final grading position Ge. At this time, the arm cylinder 9 is gradually expanded or contracted, and the variable angle βL of the arm 3 is controlled to be smaller than the initial pivot angle β. On the other hand, the boom cylinder 8 is gradually expanded or contracted, and the variable angle γL of the boom 2 is controlled to be a little larger than the initial pivot angle γ. The angular movement of the bucket 4 is maintained constantly to the pivot angle α under the control of the electronic control unit 14.

The angular movements of the arm 3 and boom 2 to the final grading positions Ge are variably performed. If the starting points for the initial grading positions Gi are different to perform the grading work, they are just recognized by the electronic control unit 14 through the predetermined control algorithm.

If the angular movements of the bucket 4, arm 3 and boom 2 from the initial grading positions Gi to the final grading positions Ge are finished, the grade control signals inclusive of the flow rate required for the cylinders 8, 9 and 10 and electrical signals required for the angular movements of the bucket 4, arm 3 and boom 2 are determined and controlled in the electronic control unit 14 in accordance with the predetermined control algorithm.

Accordingly, through the grade control signals outputted from the electronic control unit 14, the angular movements of the bucket 4, arm 3 and boom 2 for the automatic grading work in the initial grading area G1 are automatically and repeatedly performed.

During the grading work, if the button of the joystick is manipulated by the operator, for example, if the operator's finger is separated from the button of the joystick 15, the automatic grading function stops.

On the other hand, if the grading history storage switch 18 on the switch panel 20 is manipulated by the operator, the angular movements of the complicated operation would are performed manually in the initial grading area G1 and recorded in the electronic control unit 14 as the grading history data.

If the history grading mode is selected through the manipulation of the history grading switch 19, however, the angular movement of the bucket 4 is fixed to the pivot angle α in accordance with the predetermined control algorithm, and the pivot angle α is constantly maintained until the final grading position Ge.

In the initial grading area, contrarily, the angular movements of the arm 3 and boom 2 are variable until the final grading position Ge. In the contiguous grading area G2, further, the angular movements of the boom 2, arm 3 and bucket 4 are repeatedly performed in accordance with the grade control signals recorded in the electronic control unit 14 at the step S200.

At this time, the grade input signals include the swing movement θ of the vehicle body 1 calculated and corrected in accordance with the predetermined control algorithm, so that the grading function from the initial grading area G1 to the contiguous grading area G2 can be automatically repeated.

During the history grading work, if the button of the joystick 15 is manipulated by the operator, for example, if the operator's finger is separated from the button of the joystick 15, the history grading function stops.

INDUSTRIAL APPLICABILITY

As mentioned above, according to the present invention, there is provided the automatic grading system for a construction machine and the method for controlling the same that is capable of allowing the operator to easily select the standard grading mode and the history grading mode in accordance with the states of the ground to be graded and constantly maintaining the angular movement of the bucket at a initial pivot angle or starting angle, while variably controlling the angular movements of the boom and arm, in accordance with the selected grading mode.

The invention claimed is:

1. An automatic grading system for a construction machine, comprising:

a work apparatus having a boom connected pivotally to one side of a vehicle body, an arm connected pivotally to a front end portion of the boom, and a bucket connected pivotally to a front end portion of the arm;

a boom angle detection sensor mounted on one side of the boom so as to sense the angular movement of the boom with respect to the vehicle body;

an arm angle detection sensor mounted on one side of the arm so as to sense the angular movement of the arm with respect to the boom;

a switch panel on which a standard grading mode switch, a grading history storage switch, and a history grading mode switch selected for a grading work are disposed;

an electronic control unit adapted to receive grade input signals applied from the angle detection sensors at the time when the grading mode switches and a joystick for controlling the work apparatus are manipulated and to calculate the grade input signals in accordance with a predetermined control algorithm to output grade control signals for controlling the angular movements of the boom, arm and bucket, so that the angular movement of the bucket is fixed to a given starting angle from an initial grading position to a final grading position and the angular movements of the boom and arm are determined as variable angles to maintain the given starting angle; and work apparatus control valves adapted to control the hydraulic pressures for driving a boom cylinder, an arm cylinder and a bucket cylinder in response to the grade control signals; and a swing angle detection sensor mounted on one side of the vehicle body; wherein:

when the standard grading mode switch is turned on, the boom, arm, and bucket are moved to an initial grading area and the angular movement of the bucket is fixed to a given starting angle; and when the history grading mode switch is manipulated, the grade control signals determined by the angular movements of the boom, arm, and bucket within the initial grading area from the initial grading position to the final grading position are recorded as grading history data in the electronic control unit, and through the grading history data the work apparatus is repeatedly operated in a continuous grading area from the initial grading area.

2. The automatic grading system according to claim 1, wherein the grade control signals comprise flow rate control signals required for driving the boom cylinder and the arm cylinder to perform the angular movements of the boom and arm.

3. The automatic grading system according to claim 1, wherein the joystick for controlling the work apparatus includes a hydraulic joystick having a proportional pressure control valve block controlled by the electronic control unit.

4. The automatic grading system according to claim 3, wherein the proportional pressure control valve block comprises a solenoid valve.

5. A method for controlling an automatic grading system for a construction machine, the automatic grading system comprising: a switch panel having a plurality of mode switches installed in one side of a vehicle body, a plurality of angle detection sensors for sensing an angular movement of a work apparatus including boom, arm and bucket, an electronic control unit for calculating and outputting grade control signals in accordance with a predetermined control algorithm to control the angular movements of the boom, arm and bucket, and work apparatus control valves adapted to control the hydraulic pressures for activating a boom cylinder, an arm cylinder and a bucket cylinder in response to the grade control signals, the method including the steps of:

performing a standard grading mode in an initial grading area when a standard grading mode switch is turned on, the boom, arm and bucket are moved to an initial grading position and set to respective initial angles γ, β, and α (at a first step);

when the boom, arm and bucket are moved from the initial grading position to a final grading position, calculating the grade control signals inclusive of the angular movements of the boom, arm and bucket and the flow rates required for driving the cylinders in response to input values of the boom angle detection sensor, the arm angle detection sensor and the bucket angle detection sensor in accordance with the predetermined control algorithm in the electronic control unit and determining the angular movements of the boom and arm as given boom variable angle γL and arm variable angle 3L so as to maintain the initial angle a of the bucket (at a second step);

recording the calculated and determined grade control signals in the electronic control unit when a grading history storage switch is manipulated (at a third step); and moving and arranging the boom, arm and bucket to the initial grading position when the history grading mode switch is turned on and repeatedly performing the angular movements of the boom, arm and bucket in accordance with the recorded grade control signals in the contiguous grading area from the initial grading area;

wherein the grade control signals include a swing angle θ of the vehicle body detected by a swing angle detection sensor.

6. The method for controlling an automatic grading system according to claim 5, further comprising the step of cutting off the grade control signals to release the grading mode if the button of the joystick is manipulated again after the second step.

7. An automatic grading system for a construction machine comprising:

a work apparatus having a boom pivotally connected to a vehicle body, an arm pivotally connected to the boom, and a bucket pivotally connected to the arm;

a boom angle detection sensor mounted to the boom to sense angular movement of the boom relative to the vehicle body;

an arm angle detection sensor mounted to the arm to sense angular movement of the arm with respect to the boom;

a swing angle detection sensor mounted to the vehicle body;

a selector panel for grading work that includes a standard grading mode selector, a grading history storage selector, and a history grading mode selector;

an electronic control unit configured to:

receive grade input signals from the boom angle detection sensor, the arm angle detection sensor, and the swing angle detection sensor when a joystick for controlling the work apparatus is manipulated to perform grading; and calculate the grade input signals in accordance with a predetermined control algorithm to output grade control signals for controlling angular movements of the boom, arm, and bucket so that angular movement of the bucket is fixed to a given starting angle from an initial grading position to a final grading position, and angular movements of the boom and arm are determined as variable angles to maintain the given starting angle of the bucket; and work apparatus control valves configured to control hydraulic pressures for driving a boom cylinder, an arm cylinder, and a bucket cylinder in response to the grade control signals; and wherein:

when the standard grading mode selector is selected, the boom, arm, and bucket are moved to a first grading area and the angular movement of the bucket is fixed to the given starting angle;

when the history grading mode selector is selected, grade control signals determined by angular movements of the boom, arm, and bucket within the first grading area from the initial grading position to the final grading position are recorded as grading history data in the electronic control unit; and the electronic control unit operates the boom, arm, and bucket based on the recorded grading history to grade a second grading area that is contiguous with the first grading area.

* * * * *